US011785993B1

(12) United States Patent
Zuniga

(10) Patent No.: US 11,785,993 B1
(45) Date of Patent: Oct. 17, 2023

(54) SECURITY AND SAFETY SPORTS BRA

(71) Applicant: Alison Kara Zuniga, San Jose, CA (US)

(72) Inventor: Alison Kara Zuniga, San Jose, CA (US)

( * ) Notice: Subject to any disclaimer, the term of this patent is extended or adjusted under 35 U.S.C. 154(b) by 0 days.

(21) Appl. No.: 18/342,365

(22) Filed: Jun. 27, 2023

Related U.S. Application Data

(60) Provisional application No. 63/371,304, filed on Sep. 2, 2022.

(51) Int. Cl.
*A41C 3/00* (2006.01)

(52) U.S. Cl.
CPC ..... *A41C 3/0028* (2013.01); *A41C 3/0035* (2013.01)

(58) Field of Classification Search
CPC ..... A41C 3/0028; A41C 3/0035
See application file for complete search history.

(56) References Cited

U.S. PATENT DOCUMENTS 2,436,430 A * 2/1948 Hart ..... A41C 3/0035 D2/709
2,492,862 A * 12/1949 Harvey ..... A41C 3/0035 D2/709
2,503,847 A * 4/1950 Shanahan ..... A41C 3/0035 D2/857
2,593,711 A * 4/1952 Weatherly ..... A41C 3/0035 2/247
2,624,881 A * 1/1953 Dunson ..... A41C 3/0035 224/648
5,496,205 A 3/1996 Lee
6,099,382 A * 8/2000 Wilson ..... A41C 3/0057 2/247
6,176,761 B1 * 1/2001 Underhill ..... A41C 3/0014 450/1
6,517,410 B1 * 2/2003 Underhill ..... A41C 3/0057 450/1
8,771,036 B2 7/2014 Gentry et al.
D733,394 S 7/2015 Gentry et al.
9,289,016 B1 3/2016 Groff
D814,253 S 4/2018 Boyd
9,943,120 B1 * 4/2018 Rendone ..... A41C 3/0014
10,010,111 B2 * 7/2018 Rostami ..... A24F 40/10
10,219,550 B1 * 3/2019 Goff ..... A41C 3/0035
10,238,152 B2 3/2019 Rendone
10,244,860 B1 * 4/2019 Valeri ..... A47B 3/10
D851,858 S 6/2019 Hunter et al.
(Continued)

*Primary Examiner* — Gloria M Hale
(74) *Attorney, Agent, or Firm* — Stephen E. Zweig

(57) ABSTRACT

A multi-pocket sports bra device configured to cover both of the human user's breasts, usually without separate cups. The front of the bra has multi-layer construction configured to form both an outer front pocket and a separate inner front pocket. Both pockets can span the user's breast regions, thus providing extra space. The outer front pocket has a zippered side mounted front pocket opening, and the inner front pocket has a zippered top mounted front pocket opening. The back of the bra has a back pocket positioned between the user's shoulder blades, which has a top mounted back pocket opening. The bra may have optional bra strap pockets positioned by the user's front shoulders, and one or more ribcage pockets positioned on the front of a ribcage strap on the bottom of the bra that encircles the user's rib cage.

13 Claims, 8 Drawing Sheets

(56) References Cited

U.S. PATENT DOCUMENTS

| | | | | |
|---|---|---|---|---|
| 10,314,344 | B2 * | 6/2019 | Wittstadt | A41C 3/0035 |
| 10,798,977 | B1 * | 10/2020 | Ransom | A41C 3/0035 |
| 10,859,510 | B2 * | 12/2020 | Bohren | G01N 21/952 |
| 10,869,510 | B1 * | 12/2020 | Goff | A41C 3/0035 |
| 11,406,141 | B2 | 8/2022 | Graus et al. | |
| 11,717,035 | B2 * | 8/2023 | Wittstadt | A41C 3/0057 450/70 |
| 2006/0121825 | A1 * | 6/2006 | Fisher | A41C 3/0035 450/54 |
| 2008/0032600 | A1 * | 2/2008 | Updyke | A41C 3/0057 450/89 |
| 2008/0261489 | A1 * | 10/2008 | Sweeney | A41C 3/0057 450/39 |
| 2012/0064799 | A1 * | 3/2012 | Rivers | A41C 3/0035 450/86 |
| 2015/0296895 | A1 * | 10/2015 | Muir | A41C 3/0035 450/89 |
| 2016/0295929 | A1 * | 10/2016 | Cataldo | A41C 3/0035 |
| 2018/0132541 | A1 * | 5/2018 | Wittstadt | A41C 3/0057 |
| 2018/0332904 | A1 * | 11/2018 | Rendone | A41C 3/0035 |
| 2019/0254358 | A1 * | 8/2019 | Wittstadt | A41C 3/0057 |
| 2020/0323280 | A1 * | 10/2020 | Smith | A41C 3/12 |
| 2021/0219628 | A1 * | 7/2021 | Rendone | A41F 15/00 |

* cited by examiner

SECURITY AND SAFETY SPORTS BRA

CROSS-REFERENCE TO RELATED APPLICATIONS

This application claims the priority benefit of U.S. provisional application 63/371,304, filed Sep. 2, 2022, the entire contents of which are incorporated herein by reference.

BACKGROUND OF THE INVENTION

Field of the Invention

This invention is in the field of sports bras.

Description of the Related Art

Outdoor sports enthusiasts, such as runners and joggers, typically desire to wear sports clothing designed to allow high mobility and good airflow. Such clothing can include sports bras and the like. One problem such enthusiasts often face, however, is personal security. Runners and joggers often run in locations and times of the day where they may be more vulnerable to random attacks or harassment by either humans or animals.

Although such sports enthusiasts could carry security devices in their hands or by auxiliary lanyards or pouches, such methods are cumbersome. Runners and joggers usually prefer to run with their hands free, and lanyards and pouches usually become irritating to use after a short time. As a result, some turn to sports bras designed with pockets to hold various materials, such as cellular phones, identification, keys, and security devices (jackknives, alarms, pepper spray, etc.) close to the body. This allows such materials to be carried in a hands-free, non-irritating manner.

Prior art in this area includes Wilson, U.S. Pat. No. 6,099,382; Lee, U.S. Pat. No. 5,496,205; and Hart, U.S. Pat. No. 2,436,430. More recent work includes Gentry, U.S. Pat. Nos. 8,771,036 and D733,394; as well as Groff U.S. Pat. No. 9,289,016; Boyd D184,253; Rendone U.S. Pat. Nos. 9,943,120 and 10,238,152; Lucas, U.S. Pat. No. 11,406,141; Wittstadt, U.S. Pat. No. 10,314,344; and Hunter D951,858; the entire contents of these disclosures are incorporated herein by reference.

Nonetheless, further advancements would be desirable.

BRIEF SUMMARY OF THE INVENTION

The present invention was inspired, in part, by the insight that prior art storage bras do not offer their users sufficient storage flexibility. The present invention was also inspired, in part, by the insight that prior art storage bras tended to provide storage pockets in areas of the bra that are more prone to movement during exercise.

The present invention was also inspired, in part, by the insight that modern stretchable fabrics can adequately support breasts, at least for a limited time during exercise, without requiring explicit "cup" structures. Instead, adequate breast support can be achieved during exercise using suitable breathable and stretchable fabrics, such as spandex, without explicit cups. This allows for designs with at least some pockets that can span both of the user's breasts.

Note that here, the term Spandex is used in the generic sense to denote an elastomeric fiber type material, typically formed from segmented polyurethane. This type of material, which also includes Lycra® and other various variants, is elastic and durable, but since it tends to stick to the body, is often combined with a more breathable fabric for comfort. Lycra® is a trademark of DuPont company.

Further, the present invention was also inspired, in part, by the insight that suitable locations for other auxiliary pockets include regions of the body, such as the back, shoulders, and waist, that tend to move less during exercise.

Accordingly, the present invention teaches a multi-pocket bra device comprising a front panel, back panel, left and right adjustable bra straps, and a ribcage strap. The front panel is typically configured to cover both of the human user's breasts and will often be a three-layer design that can form both an outer front pocket and a separate inner front pocket. Here both pockets can span the user's breast regions. The outer front pocket can be accessed by a side-mounted front pocket opening (often equipped with a zipper), while a top-mounted front pocket opening can access the inner front pocket, also often equipped with a zipper. The back of the bra will usually have a back panel with a back pocket positioned between the user's shoulder blades, often equipped with a top-mounted back pocket opening.

In some embodiments, the bra device may also have other auxiliary pockets as well, such as one or more bra strap pockets positioned by the user's front shoulders and one or more ribcage pockets set on a ribcage strap configured to bottom portions of the front panel and the back panel, and to encircle the user's rib cage.

DETAILED DESCRIPTION OF THE INVENTION

Figure 1:
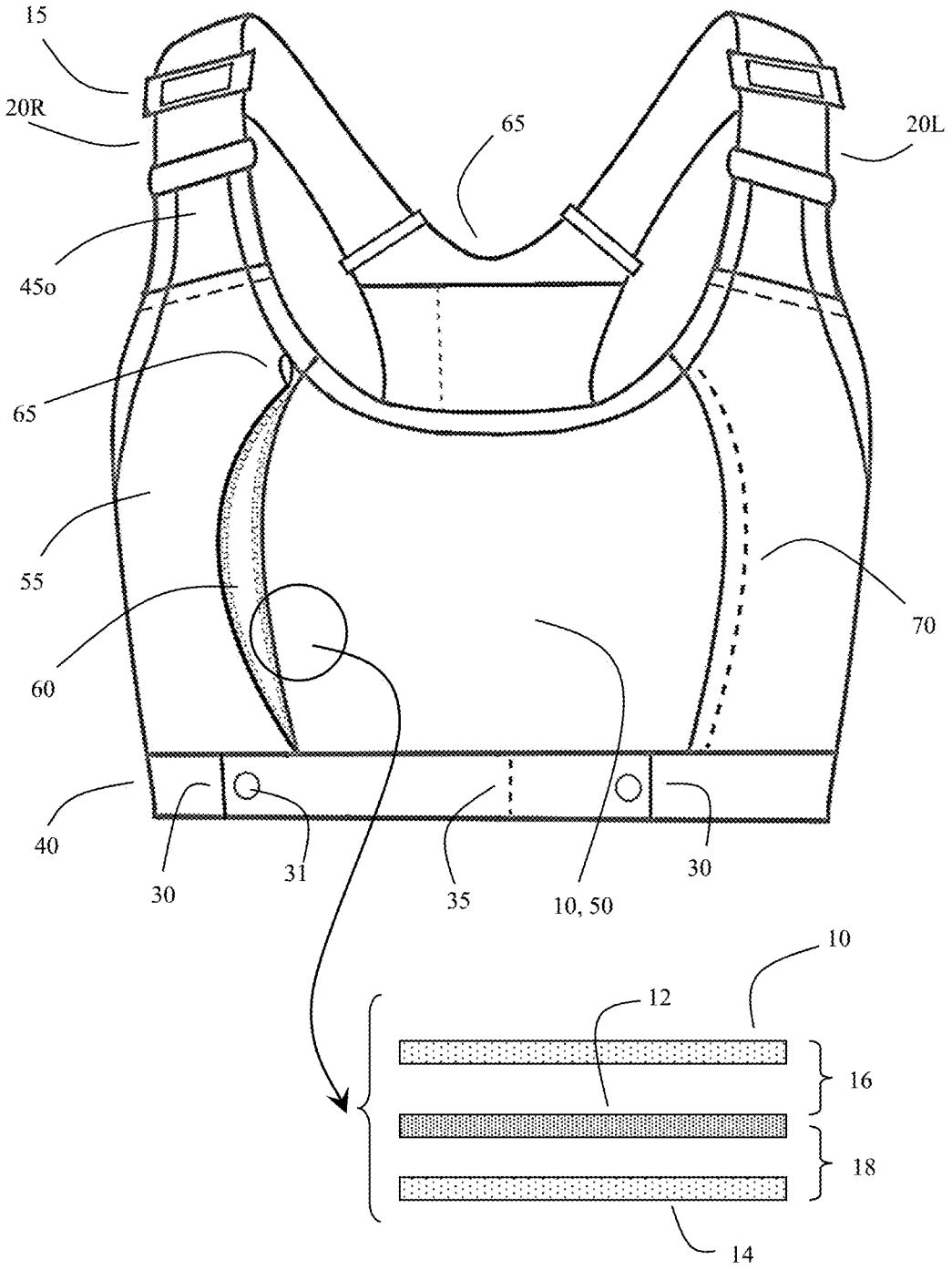
FIG. 1 shows the external front of the sports bra.

FIG. 1 shows the external front of the sports bra. This will typically comprise a front panel (50) formed from material (10), back panel (65), left and right adjustable bra straps (20L, 20R), and a ribcage strap (40). The sports bra will often be constructed of various fabrics, such as spandex, power mesh, and ponte fabric.

Power mesh fabric is often made from synthetic polyester or nylon fibers, and is generally an elastic durable material. Ponte fabric is a double-knit fabric, often composed of any of natural (e.g., cotton) synthetic (nylon, spandex), or blend type fabrics.

At least portions of this front panel (50) will typically comprise an outer front layer (10). Note that at least parts of the front of the bra, positioned below the outer front layer, can also comprise a middle front layer (12) and an inner front layer (14). Thus at least portions of the front panel may comprise three layers (10, 12, and 14).

Figure 1A:
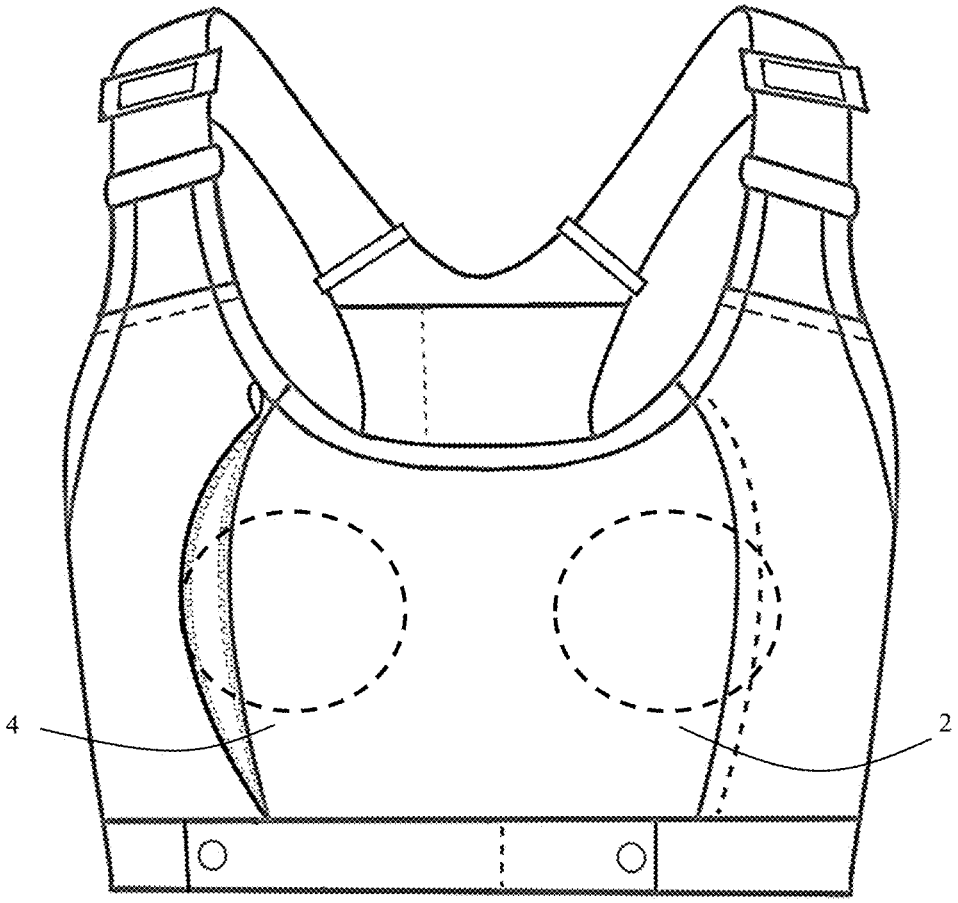
FIG. 1A shows the approximate location of the human user's left and right breasts.

FIG. 1A shows the approximate location of the human user's left and right breasts.

As shown in FIG. 1A, the human user typically has a left and a right breast (2, 4). The front panel (50) may comprise elastic material (10) and/or extra material so as to accommodate the user's breasts in this region but will generally not comprise actual breast cups.

Returning to FIG. 1, the front panel (50) will typically also further comprise an outer front pocket between the outer front layer and the middle front layer, the outer front pocket (see opening 60) configured with an outer front pocket enclosure (16), which may be formed by the gap between the outer front layer (10) and the middle front layer (12), and may optionally contain a lining. This front pocket enclosure will typically extend between at least a middle portion of the user's left breast (2) and at least a middle portion of the user's right breast (2), and have a side-mounted outer front pocket opening (60).

In some embodiments, it may be desirable to add some extra thickness to some of the pockets, such as the front panel pocket, so that the outline of any objects in the pocket is muted. This extra thickness may be provided by a range of materials, which may include neoprene (e.g., the material used for wetsuits) and other space-filling materials.

Figure 2:
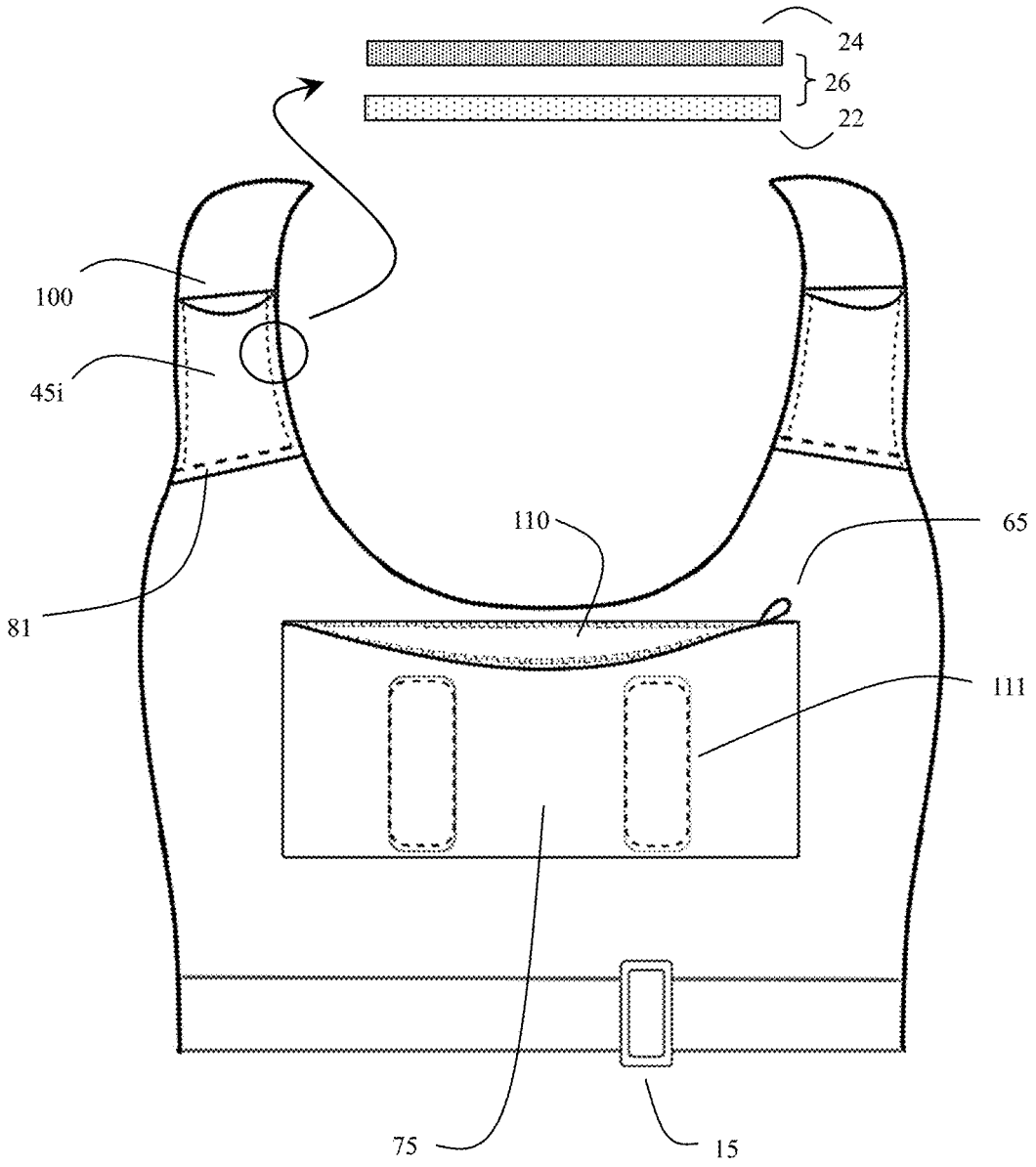
FIG. 2 shows the internal front of the sports bra.

The front panel may further comprise an inner front pocket (see FIG. 2, 75) between the middle front layer (12) and the inner front layer (14). This inner front pocket may be configured with an inner front pocket enclosure (18) that spans between at least a middle portion of the user's left breast (2) and at least a middle portion of the user's right breast (4). This pocket will generally have a top-mounted inner front pocket opening (FIG. 2, 110).

The bra's back panel (65) is generally configured to cover at least a portion of the user's back. In some embodiments, at least portions of this back (65) panel can further comprise an outer back layer (66) and an inner back layer (67). This back panel will typically further comprise a back pocket (see opening 66) between the outer back layer (66) and the inner back layer (67). This back pocket is configured with an outer back pocket enclosure (68) that spans at least portions of the center of the back pocket and the top-mounted back pocket opening (66).

Figure 7:
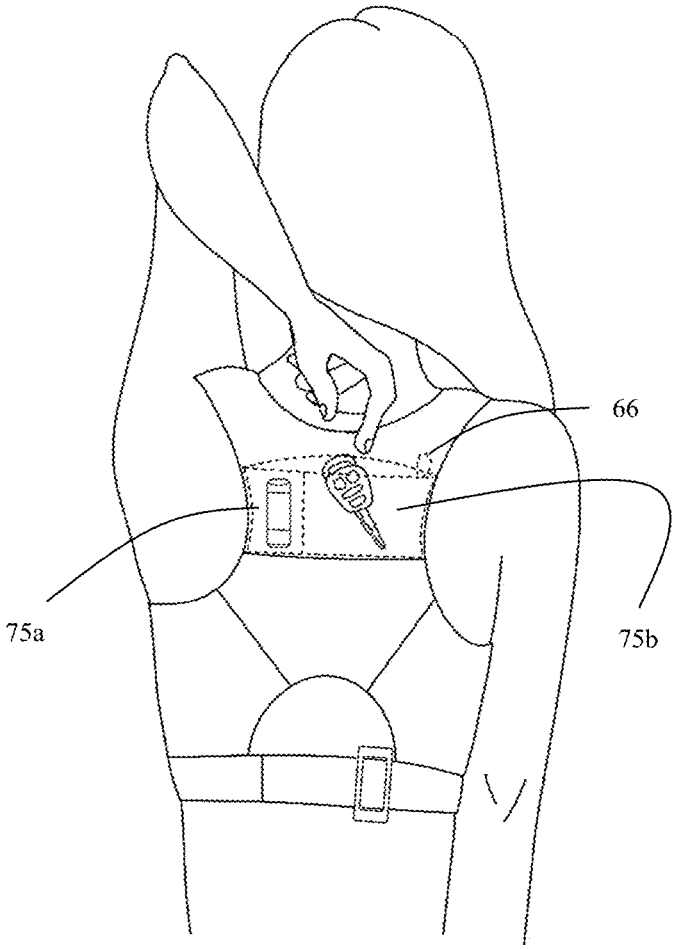
FIG. 7 shows a human user inserting an object into the sports bra's exterior back shoulder blade pocket.

FIG. 7 shows a human user inserting an object (such as keys or a pocket knife) into the interior opening (66) of the back shoulder blade pocket of the sports bra.

In some embodiments, this back pocket further comprises a divider configured to divide the back pocket into two sections. See FIG. 7 (75*a*) and (75*b*).

The bra also comprises left (20L) and right (20R) adjustable bra straps that are configured to attach to the left and right top portions of the front panel (50). These bra straps are configured to extend over the human user's left and right shoulders (see FIG. 4 to FIG. 7), and attach to the back panel's left and right top portions . By contrast, the ribcage strap (40) is configured to connect to the bottom portions of the front panel (50) and back panel (65) and to encircle the human user's rib cage, again as per FIG. 4 to FIG. 7.

FIG. 2 shows the internal front (inside of the front) of the sports bra. In some embodiments, any of the side-mounted outer front pocket opening (60), the top-mounted inner front pocket opening (110), and the top-mounted back pocket opening (66) can further comprise any of a zipper, button, or hook and loop type attachment or fastener device.

Figure 6:
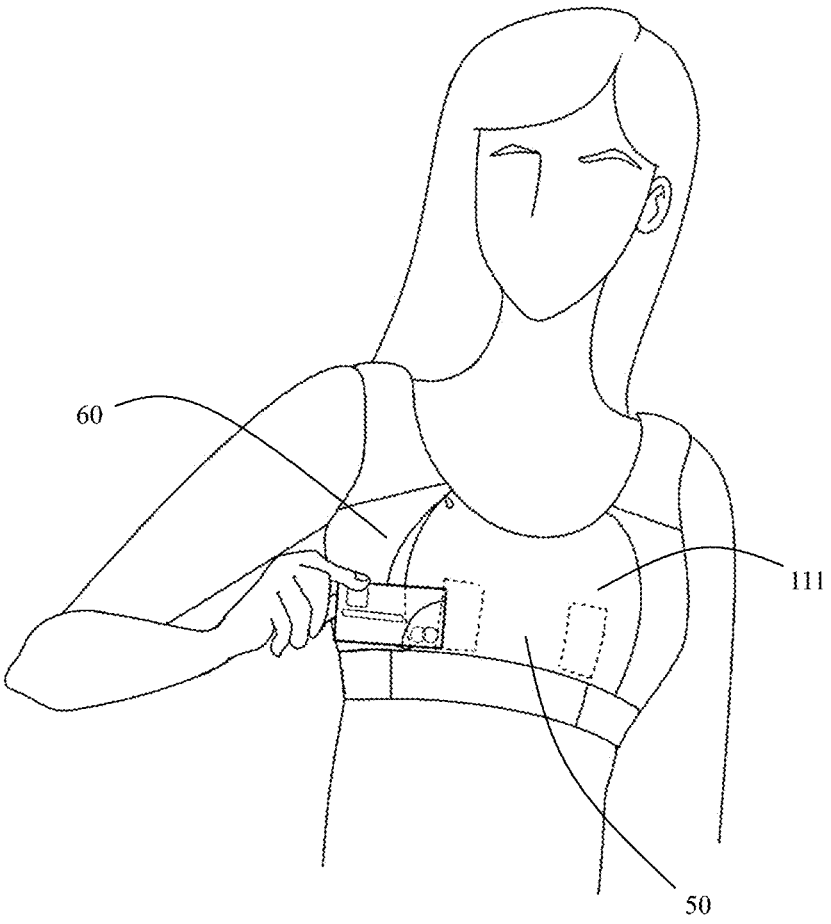
FIG. 6 shows a human user inserting an object into the external front panel pocket of the sports bra.

FIG. 6 shows a human user inserting an object (such as a driver's license or credit card) into the side opening (60) of the external front panel pocket of the sports bra.

Users may often want to store their smartphones or cell phones in either the front or back pocket. To keep the phones from moving inside the pocket while stored, in some embodiments, it may be helpful to further enclose one or more cell phone pocket anchors inside the front or back pocket. These anchors (111) can be of various types, including elastic loops, magnets, or hook-and-loop attachment anchors, which may be used to keep the cell phone from moving while the user is exercising.

Also, as shown in FIG. 2, in some embodiments, at least portions of at least one of the left and right adjustable bra straps, such as (20R) or (20L), further comprise a bra strap outer layer (24) and a bra strap inner layer (22), and at least one internal front bra strap pocket 45(*i*) positioned on an inner side of the straps. This at least one internal front bra strap pocket is positioned between (26) the bra strap outer layer (24) and the bra strap inner layer (22). Additionally, this and the at least one internal front bra strap pocket is configured with an internal front bra strap pocket enclosure and stitching (81) that covers at least the bottom and sides of the internal front bra strap pocket. This pocket is further configured with a top-mounted internal front bra strap pocket opening (100).

Figure 4:
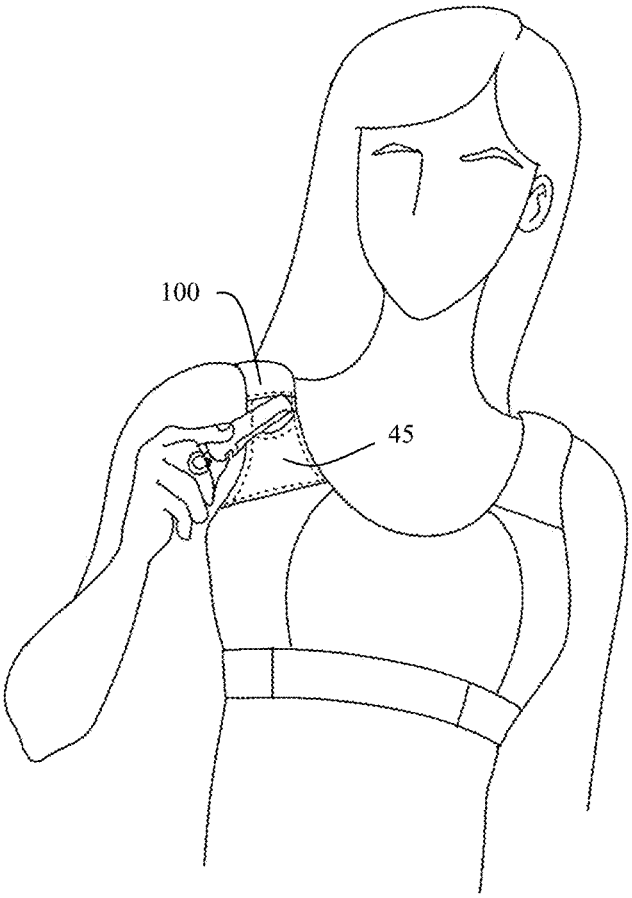
FIG. 4 shows a human user inserting a whistle into an internal front strap pocket of the sports bra.

FIG. 4 shows a human user inserting a whistle into an interior top opening (100) of the internal front strap pocket of the sports bra.

In some embodiments, as shown in FIG. 2, the bra strap outer layer (24) can comprise a spandex fabric; and the bra strap inner layer (22) can comprise a power mesh fabric. Here, the outer layer (24) is the layer that faces the outside when the user is wearing the sports bra.

Returning to FIG. 1, in some embodiments, at least portions of the ribcage strap (40) can comprise a ribcage strap outer layer and a ribcage strap inner layer. This ribcage strap can also comprise at least one outer ribcage pocket (see opening 30). This outer ribcage pocket can be positioned on a front side of the strap. This at least one outer ribcage pocket can further comprise an outer ribcage pocket enclosure that covers at least a top and bottom of the pocket. As previously discussed, this at least one outer ribcage pocket can further comprise at least one side-mounted outer ribcage pocket opening (30).

As per the other pockets, in some embodiments, the ribcage strap outer layer can comprise an elastic fabric band, such as spandex or other elastic fabric, and the ribcage strap inner layer can comprise a power mesh fabric.

Figure 5:
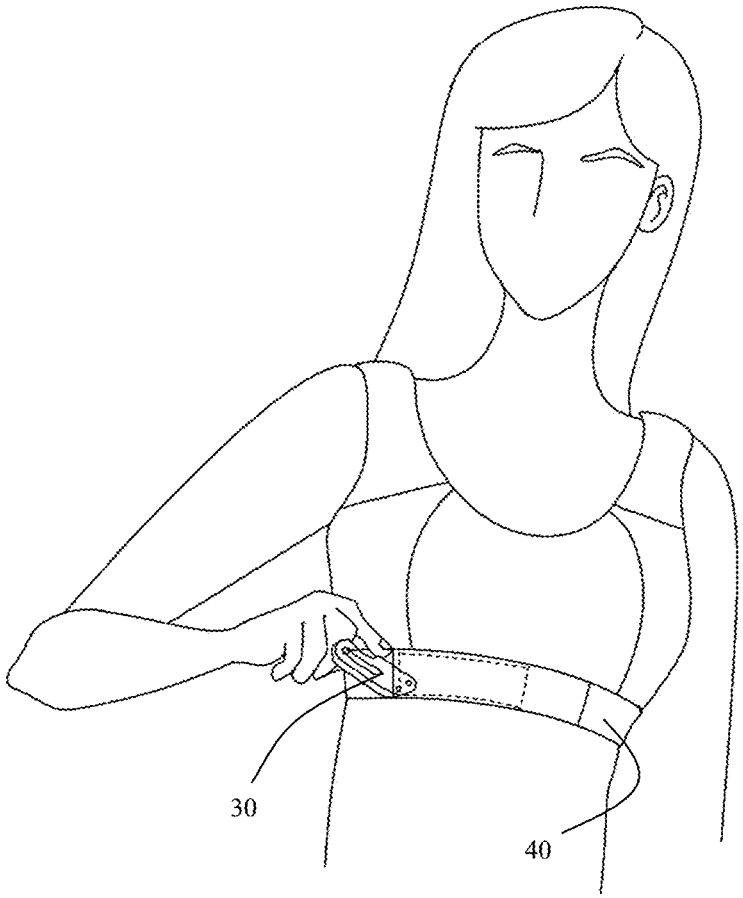
FIG. 5 shows a human user inserting an object into a ribcage strap pocket of the sports bra.

As shown in FIG. 1 and FIG. 5, in some embodiments, the at least one outer ribcage pocket enclosure can further comprise a divider (35) (often formed by stitching), essentially dividing the pocket into two sections. This double ribcage pocket will usually have two side-mounted outer ribcage pocket openings (30). In other words, this divider (35) is configured to divide this at least one outer ribcage pocket enclosure into two outer ribcage pocket enclosures. In some embodiments, this at least one outer ribcage pocket opening can further be opened and closed by any of a snap device, button, or hook and loop attachment devices (31).

FIG. 5 shows a human user inserting an object into an opening (30) of the ribcage strap pocket of the sports bra.

Figure 3:
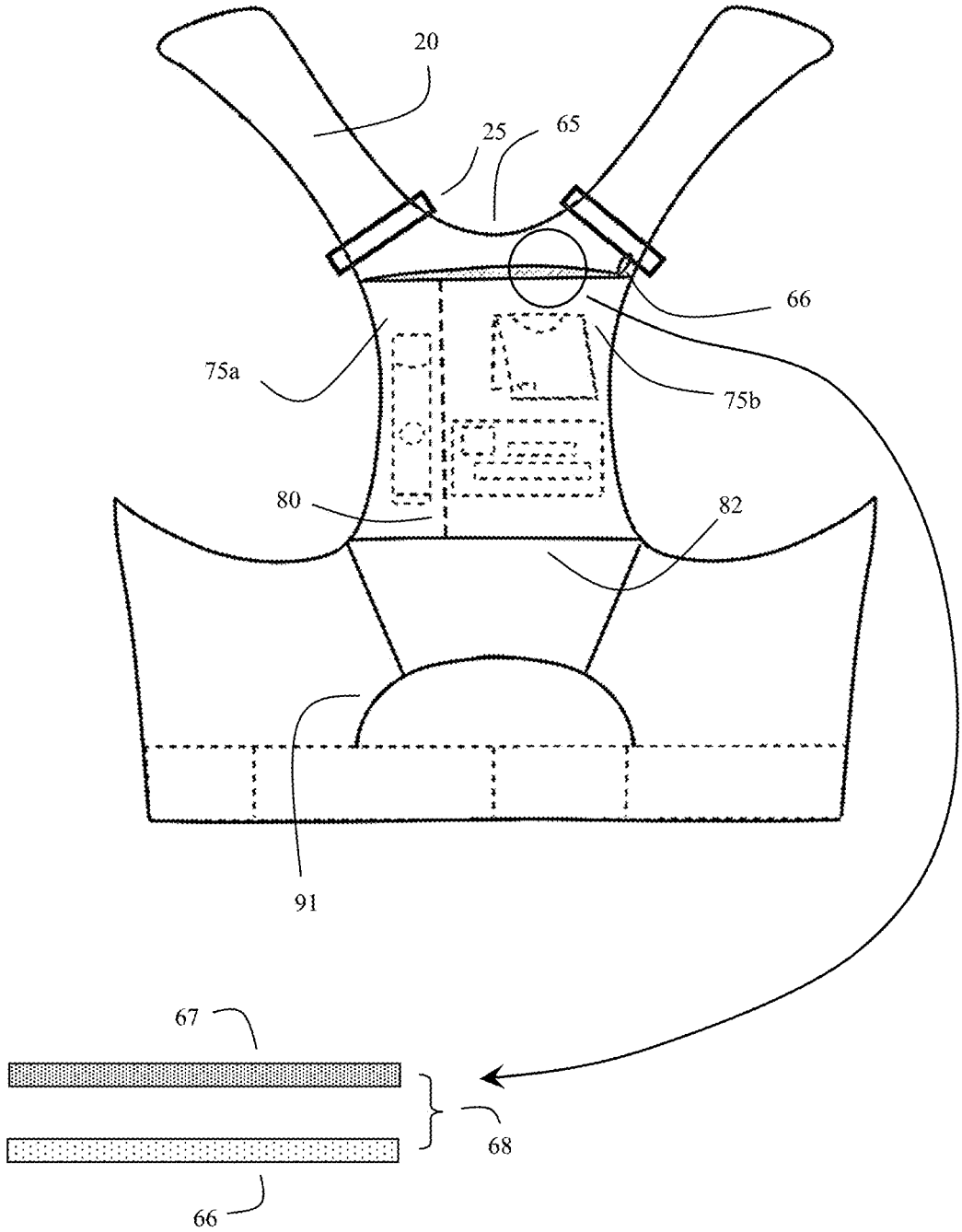
FIG. 3 shows the internal back of the sports bra.

FIG. 3 shows the internal back of the sports bra. This is the back portion of the sports bra, as seen from the inside. This portion usually is in contact with the user's back. The external back of the sports bra is shown in FIG. 7.

Bra Materials:

The sports bra can be constructed out of a wide variety of fabrics and other materials. In a preferred embodiment, the outer front layer and the outer back layer will comprise a spandex fabric. The middle front layer and the inner back layer can comprise any of a power mesh fabric and ponte fabric. In some embodiments, the inner front layer may also comprise any of a spandex fabric and a ponte fabric. Additionally, as desired, any of the pockets can additionally comprise a waterproof lining made from a suitable water-resistant or waterproof fabric.

Other Features:

In some embodiments, it may also be useful to attach at least one QR code to the sports bra. This QR code can be part of a fabric or plastic tag, or directly printed on the bra material itself, and can be positioned in the back of the bra, or alternatively in the interior of one or more pockets. This QR code can be used, for example, to link to a video/website related to that pocket. For example, the rear pocket or bra strap pocket (where a pocket knife could be stored) could contain a QR code that links to the URL of an online (internet) self-defense video. A pocket that could be used to store pepper spray could include a QR code that links to the URL of an online (internet) pepper spray video, and so on.

The invention claimed is:

1. A pocket bra for a human user, said pocket bra comprising a front panel, back panel, left and right adjustable bra straps, and a ribcage strap;

said front panel configured to cover both said human user's left breast and right breast;

at least portions of said front panel comprising an outer front layer, a middle front layer, and an inner front layer;

said front panel further comprising an outer front pocket between said outer front layer and said middle front layer, said outer front pocket configured with an outer front pocket enclosure that spans between at least a middle portion of said user's left breast and at least a middle portion of said user's right breast, and a side mounted outer front pocket opening;

said front panel further comprising an inner front pocket between said middle front layer and said inner front layer, said inner front pocket configured with an inner front pocket enclosure that spans between at least a middle portion of said user's left breast and at least a middle portion of said user's right breast, and a top mounted inner front pocket opening;

said back panel configured to cover at least a portion of said human user's back;

at least portions of said back panel further comprising an outer back layer and an inner back layer;

said back panel further comprising a back pocket between said outer back layer and said inner back layer, said back pocket configured with an outer back pocket enclosure that spans at least portions of a center of said back pocket, and a top mounted back pocket opening;

wherein said left and right adjustable bra straps are configured to attach to left and right top portions of said front panel, and are configured to extend over said human user's left and right shoulders, and attach to left and right top portions of said back panel; and wherein said ribcage strap is configured to attach to bottom portions of said front panel and said back panel, and to encircle said human user's rib cage.

2. The pocket bra of claim 1, wherein any of said side mounted outer front pocket opening, said top mounted inner front pocket opening, and said top mounted back pocket opening comprises any of a zipper, buttons, or hook and loop attachment devices.

3. The pocket bra of claim 1, wherein any of said front pocket and said back pocket further comprise at least one internal cell phone pocket anchor.

4. The pocket bra of claim 3, wherein said at least one internal cell phone pocket anchor comprises any of elastic loops, hook and loop attachment devices, and magnetic attachment devices.

5. The pocket bra of claim 1, wherein at least portions of at least one of said left and right adjustable bra straps further comprise a bra strap outer layer and a bra strap inner layer, and at least one internal front bra strap pocket positioned on an inner side of said straps;

said at least one internal front bra strap pocket comprising a bottom, sides, and a top-mounted internal front bra strap pocket opening; and said at least one internal front bra strap pocket is positioned between said bra strap outer layer and said bra strap inner layer;

further, this said at least one internal front bra strap pocket is configured with an internal front bra strap pocket enclosure that covers at least said bottom and said sides of said internal front bra strap pocket.

6. The pocket bra of claim 5, wherein said bra strap outer layer comprises a spandex fabric; and said bra strap inner layer comprises a power mesh fabric.

7. The pocket bra of claim 1, wherein at least portions of said ribcage strap comprise a ribcage strap outer layer and a ribcage strap inner layer, and at least one outer ribcage pocket positioned on a front side of said strap;

said at least one outer ribcage pocket comprising an outer ribcage pocket enclosure that covers at least a top and bottom of said at least one outer ribcage pocket; and said at least one outer ribcage pocket further comprising at least one side mounted outer ribcage pocket opening.

8. The pocket bra of claim 7, wherein said ribcage strap outer layer comprises an elastic fabric band; and said ribcage strap inner layer comprises an elastic fabric band.

9. The pocket bra of claim 7, wherein at least one said outer ribcage pocket enclosure further comprises a divider, and two side mounted outer ribcage pocket openings, and wherein said divider is configured to divide at least one said outer ribcage pocket enclosure into two outer ribcage pocket enclosures.

10. The pocket bra of claim 7, wherein said at least one outer ribcage pocket opening further comprises any of a snap device, button, or hook and loop attachment devices.

11. The pocket bra of claim 1, wherein said back pocket further comprises a divider configured to divide said back pocket into two sections.

12. The pocket bra of claim 1, wherein any of said pockets further comprises a waterproof lining.

13. The pocket bra of claim 1, wherein said outer front layer comprises a spandex fabric;

said middle front layer comprises any of a power mesh fabric and ponte fabric;

said inner front layer comprises any of a spandex fabric and ponte fabric:

said outer back layer comprises a spandex fabric; and said inner back layer comprises any of a power mesh fabric and a ponte fabric.

* * * * *